United States Patent [19]

Chetta, Jr.

[11] 3,984,941

[45] Oct. 12, 1976

[54] TABLE TOP WASTE RECEPTACLE

[76] Inventor: Nicholas J. Chetta, Jr., 5865 Memphis St., New Orleans, La. 70124

[22] Filed: Sept. 29, 1975

[21] Appl. No.: 617,666

[52] U.S. Cl. ..... 47/41 R; 220/1 T; 220/17; 220/20; 220/23; 220/254; 220/296; 220/334; D7/27

[51] Int. Cl.[2] ..... A47G 7/02; B65D 1/24; A47G 7/06

[58] Field of Search ..... 220/14, 1 T, 17, 20, 220/20 S, 23, 254, 296, 334; 131/238, 241, 242; 47/34 R, 34.1, 41, 41.11, 41.13, 41.5; D7/16, 27, 38; D9/18; D27/15, 21, 27

[56] References Cited

UNITED STATES PATENTS

| | | | |
|---|---|---|---|
| 1,424,520 | 8/1922 | Richardson et al. | 220/1 T X |
| 1,624,407 | 4/1927 | Hamilton | 220/23 X |
| 1,903,994 | 4/1933 | Goldman | 220/20.5 X |
| 1,907,788 | 5/1933 | Goertz et al. | 220/20.5 X |
| 1,964,513 | 6/1934 | Hammer | 220/254 |
| 2,125,122 | 7/1938 | Mongiello | 220/17 X |
| 3,378,134 | 4/1968 | Wilkinson et al. | 220/20 |
| 3,647,102 | 3/1972 | Cooley | 220/17 |
| 3,682,347 | 8/1972 | Barrier | 220/17 X |
| 3,836,037 | 9/1974 | Bass | 220/1 T X |
| 3,856,173 | 12/1974 | Deane et al. | 220/1 T |

FOREIGN PATENTS OR APPLICATIONS

| | | | |
|---|---|---|---|
| 586,154 | 11/1959 | Canada | 47/41.11 |
| 665,837 | 9/1929 | France | 131/238 |
| 363,245 | 12/1931 | United Kingdom | 131/242 |

*Primary Examiner*—William Price
*Assistant Examiner*—Stephen Marcus
*Attorney, Agent, or Firm*—Wilkinson, Mawhinney & Theibault

[57] ABSTRACT

The present disclosure is directed to a waste receptacle for use on tables in restaurants, homes or wherever food is served and the problem of collection of cracker wrappers, empty sugar or salt and pepper packets in a central point separate from ash trays is necessary and the structure has aesthetic eye appeal. A bottom collection base receptacle having an open top and a tubular member upstanding from its base supports a top assembly having a spider frame the center of which supports a tubular member, open at the top and closed at the bottom. The bottom of the tubular member is closed and is received into the open tubular member upstanding from the base receptacle. The spider frame has a plurality of trap doors spaced about the tubular member opening downwardly into the base receptacle while the open top tubular member receives shrubs or flowers rendering the waste receptacle an attractive center piece for the table.

4 Claims, 5 Drawing Figures

TABLE TOP WASTE RECEPTACLE

An object of the present invention is to provide a waste collection receptacle for table top use in homes or restaurants which is attractive and into which such items as cracker wrappings, empty sugar packets, salt and pepper and other condiment wrappings can be placed rather than posing a fire hazard by their being placed in ash trays resulting in table top fires.

Another object of the present invention is the provision of a table top waste receptacle which has a plurality of trap doors spaced around its top through which cracker wrappings or the like can be inserted by all guests seated about the table and the center of the trap door array is provided with a receptacle for shrubs or flowers to render the waste unit an attractive center piece.

With the foregoing and other objects in view the invention will be more fully described hereinafter and more particularly pointed out in the appended claims.

In the drawings in which like parts are denoted by reference characters throughout the several views.

Figure 1:
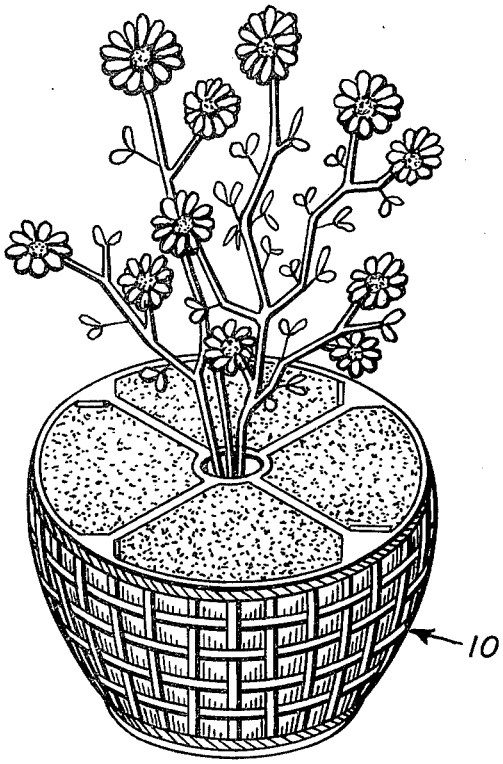
FIG. 1 is a perspective view of the table top waste receptacle of the present invention with a flower arrangement in its center.
Figure 2:
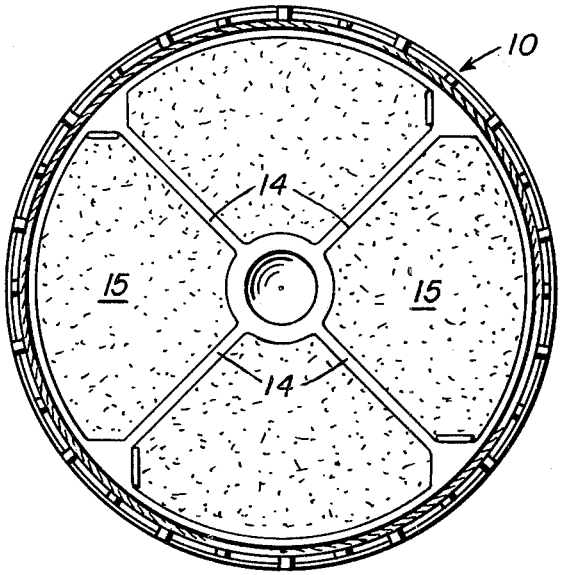
FIG. 2 is a top plan view of the receptacle of FIG. 1 with the flowers removed.

Referring now to the drawings, 10 designates an open top base receptacle having a bottom 11 which supports an upstanding tubular member 12. The top assembly 13 has a spider frame 14 which not only carries four trap doors 15 but also carries a central tube 16 having an open top 17 and a rounded closed end 18. The top assembly 13 also has inwardly projecting pins 19 which enter vertical slots 20 leading to horizontal slots 21 for a push and twist securing of the top 13 to the base 10.

Figure 5:
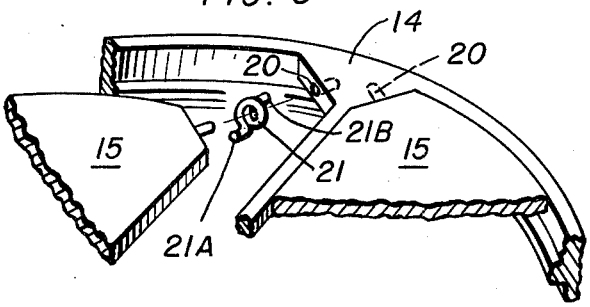
FIG. 5 is a fragmentary perspective view of the spider assembly and trap door mounting showing spring mechanism for biasing trap doors to their closed condition.

As best seen in FIG. 5 each trap door 15 is pivotally mounted to the spider frame 14 by pivot pins which are receivable into bearing openings 20 in the spider frame

14. The doors 15 are biased to an up or closed condition by a coil spring 21, one end of which 21A engages beneath the trap door and the other end 21B engages the spider frame 14.

Figure 4:
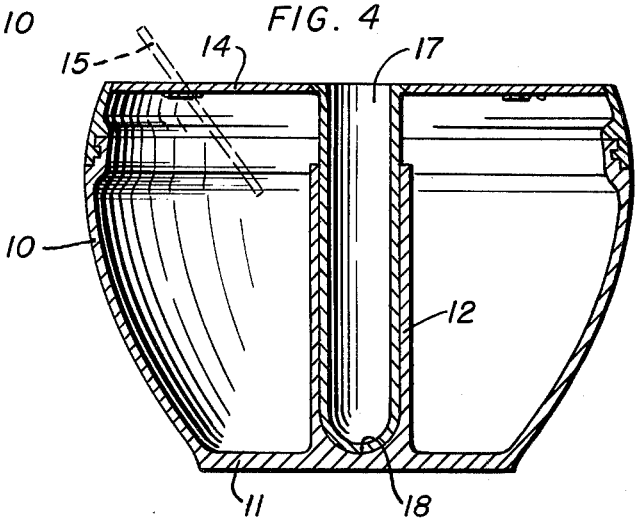
FIG. 4 is a vertical sectional view of the unit of the present invention in assembled condition.
Figure 3:
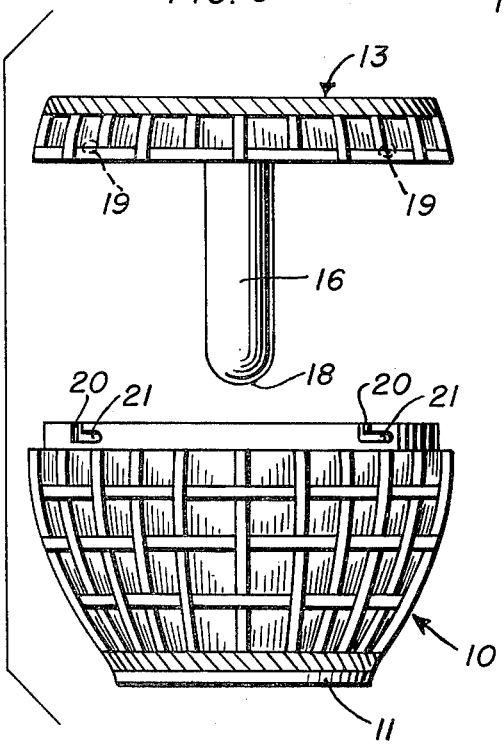
FIG. 3 is a side elevational exploded view of the top and base units of the present invention.

The unit is assembled as shown in FIG. 3 by directing the top 13 downwardly so that the closed end 18 of tube 16 enters upstanding tube 12 until the pins 19 enter vertical slots 20 until rotated and locked in horizontal slots 21. The unit then appears as shown in FIG. 4 after which a central piece of flowers 22 is inserted through opening 17 in the center tube.

When crackers are unwrapped as when soup is served the wrapping is crumpled and the trap door 15 is pressed inwardly and downwardly for insertion of the wrapping into the receptacle 10. When pressure is removed the trap door closes to the position shown in FIG. 1.

What I claim is:

1. A table top waste receptacle comprising:

a. an open top base receptacle having a first tubular member upstanding from its bottom, b. a top assembly received over and carried by the open upper end of said base receptacle, c. a spider frame carried by said top assembly, d. pivotally mounted trap doors spring biased to a normally closed position carried by said spider frame, and e. a second tubular member having one closed and one open end carried by said spider frame, said closed end being received in the tubular member upstanding from the bottom of said base receptacle and the open end of said second tubular being open above said top assembly to receive decorative shrubbery and flowers above the waste receptacle.

2. A table top waste receptacle as claimed in claim 1 wherein the top assembly is secured to said base receptacle by a pin and rotary slot connection.

3. A table top waste receptacle as claimed in claim 2 wherein said trap doors have pin projections receivable into openings in said spider frame and a coil spring having two projection seats beneath the trap door and the other projection seats beneath the spider frame to normally bias the trap door to a closed position.

4. A table top waste receptacle as claimed in claim 3 wherein there are four trap doors carried by said spider frame.

* * * * *